US010252130B2

(12) United States Patent
Matys

(10) Patent No.: US 10,252,130 B2
(45) Date of Patent: Apr. 9, 2019

(54) CLIMBING SYSTEMS AND APPARATUS

(71) Applicant: ATOMIK CLIMBING HOLDS INC, Provo, UT (US)

(72) Inventor: Kenny Michael Matys, Provo, UT (US)

(73) Assignee: ATOMIK CLIMBING HOLDS INC, Provo, UT (US)

( * ) Notice: Subject to any disclaimer, the term of this patent is extended or adjusted under 35 U.S.C. 154(b) by 210 days.

(21) Appl. No.: 15/339,263

(22) Filed: Oct. 31, 2016

(65) Prior Publication Data

US 2017/0050097 A1 Feb. 23, 2017

(51) Int. Cl.
*A63B 29/08* (2006.01)
*A63B 69/00* (2006.01)

(52) U.S. Cl.
CPC ..... *A63B 69/0048* (2013.01); *A63B 29/08* (2013.01)

(58) Field of Classification Search
CPC . A63B 69/0048; A63B 9/00; A63B 2009/006; A63B 29/00; A63B 29/08
USPC ..... 52/155
See application file for complete search history.

(56) References Cited

U.S. PATENT DOCUMENTS 3,735,434 A 5/1973 Penberty
4,064,665 A * 12/1977 Lowe ..... A63B 29/025 175/18
4,108,026 A * 8/1978 Anderson ..... A63B 29/08 29/278
5,930,884 A * 8/1999 Kammeraad ..... B25B 27/00 29/267
5,996,235 A * 12/1999 Brainerd ..... B26B 23/00 30/308.1
7,419,457 B1 * 9/2008 Sudeith ..... A63B 69/0048 482/35
D676,107 S * 2/2013 Malcarne ..... D22/149
9,149,684 B1 10/2015 Carlson et al.
2011/0319230 A1 * 12/2011 Brendle ..... A63B 23/03541 482/37
2012/0184409 A1 * 7/2012 Beal ..... A63B 69/0048 482/5
2012/0279167 A1 * 11/2012 Aly ..... A63B 9/00 52/704
2017/0240281 A1 * 8/2017 Veto ..... B64D 1/02

OTHER PUBLICATIONS

Website http://iceholdz.com (last accessed on Nov. 2, 2016).
Website http://www.dryicetools.com/purchase (last accessed on Nov. 3, 2016).

* cited by examiner

*Primary Examiner* — Nyca T Nguyen
(74) *Attorney, Agent, or Firm* — Nadesan Beck P.C.; David A. Jones

(57) ABSTRACT

Dry tooling and ice climbing training apparatus and systems. A climbing apparatus includes a handle and an anchoring appendage extending at an acute angle less than 85 degrees to the handle. An anchor receiver can include an aperture in the anchor receiver corresponding in shape to the anchoring appendage of the climbing apparatus to temporarily secure the climbing apparatus to the anchor receiver. The anchor receiver can be affixed to a surface of a structure, such as successive surfaces of an upright surface. An anchor receiver can include multiple apertures for use with different angled surfaces.

20 Claims, 10 Drawing Sheets

CLIMBING SYSTEMS AND APPARATUS

BACKGROUND

Obstacles can simulate a series of real-life challenges. Examples include a fire jump, climbing under barbed wire, wall climbing, mud crawling, spear throw, rope climb, heavy object carries, monkey bars, Traversal Wall (similar to a bouldering wall), Hobie Hop, Slippery Wall (a wall built at an incline, roughly covered in grease), a zig-zag log jump, steep mud climbs, Atlas carries, Salmon Ladder, Warped Wall, tire flips, stump balances, and rope swings.

Obstacle "problem" structures include another type of training disciplines. One example that uses obstacle structures to promote physical fitness, coordination, and balance is Parkour. Parkour uses movement that is inspired by military obstacle course training. Practitioners aim to get from one point to another in a complex environment without assistive equipment and in the fastest and most efficient way possible. Parkour includes running, climbing, swinging, vaulting, jumping, rolling, quadrupedal movement, and other movements as deemed most suitable for the situation.

Another unique activity is ice climbing. Usually, ice climbing refers to roped and protected climbing of features such as icefalls, frozen waterfalls, and cliffs and rock slabs covered with ice refrozen from flows of water. For the purposes of climbing, ice can be broadly divided into two spheres, alpine ice and water ice. Alpine ice is found in a mountain environment, usually requires an approach to reach, and is often climbed in an attempt to summit a mountain. Water ice is usually found on a cliff or other outcropping beneath water flows. Alpine ice is frozen precipitation whereas water ice is a frozen liquid flow of water. Ice climbing is a particularly difficult sport for fitness and training because it typically includes ice formations which are particularly difficult to replicate year round and in a variety of climates.

An ice axe, for example, is a multi-purpose hiking and climbing tool used by mountaineers both in the ascent and descent of routes that involve frozen conditions with snow and/or ice. An ice axe can be held and employed in a number of different ways, depending on the terrain encountered. In its simplest role, the ice axe is used like a walking stick in the uphill hand, the mountaineer holding the head in the center, with the pick pointing to the rear. It can also be buried pick down, the rope tied around the shaft form a secure anchor on which to bring up a second climber, or buried vertically to form a stomp belay. The adze is used to cut footsteps (sometimes known as pigeon holes), as well as scoop seats in the hillside and trenches to bury an ice axe belay.

FIG. 1 illustrates a traditional mountaineering ice axe 100. The ice axe 100 includes a head 102, pick 101, adze 103, leash 104, leash stop 105, shaft 106, and spike 107. The head 102 is usually made of steel and features the pick 101 and adze 103. The pick 101 is a toothed pointed end of the head 102, typically slightly curved (aiding both in ergonomics and self-arrest). The adze 103 is a flat, wide end of the head 102 used for chopping steps in hard snow and ice. The shaft 106 of the traditional ice axe 100 can be straight or slightly angled, typically wider front-to-back than side-to-side, flat on the sides and smoothly rounded on the ends. Traditional shafts 106 were made of wood, but are now almost exclusively of lightweight metals (such as aluminum, titanium and steel alloys) or composites (including fiberglass, Kevlar or carbon filament). The spike 107 can include a steel point at the base of the shaft used for balance and safety when the axe 100 is held by its head in walking stick fashion.

A climbing wall is an artificially constructed structure with grips for hands and feet, usually used for indoor climbing, but sometimes located outdoors. Some are brick or wooden constructions, but on most modern walls, the material most often used is a thick multiplex board with holes drilled into it. The wall may have places to attach belay ropes, but may also be used to practice lead climbing or bouldering.

The walls at indoor climbing gyms are usually built from prefabricated fake-rock panels or textured plywood sheets that have regularly spaced holes and are attached to a metal or wood framework inside the gym. The walls are attached to the building's structure at both the base and the top so that they are stable and don't move or flex. While most gym walls are vertical, some walls have horizontal overhangs or sections that are other than 90° from the floor. Indoor climbing walls range in height from 10 to 50 feet.

Each hole contains a specially formed t-nut to allow modular climbing holds to be screwed onto the wall. The face of the multiplex board climbing surface is covered with textured products including concrete and paint or polyurethane loaded with sand. The wall obstacle may contain angles and surface structures such as indentions (incuts) and protrusions (bulges), or take the form of an overhang, underhang, or crack. Some grips are formed to mimic the conditions of outdoor rock, including some that are oversized and can have other grips bolted onto them.

U.S. Pat. No. 9,149,684 discloses a climbing tool operative for climbing an artificial climbing wall. The tool has a strap replacing the axe portion used in outdoor climbing, where the strap engages a climbing wall hold. The tool has a grip attached to an angled shaft. The grip has a grasping portion for a hand that includes a pinky rest and a finger rest. Because the climbing tool does not have any sharp points or edges, it does not damage an artificial climbing wall.

However, because the tool uses a flexible strap to simulate the use of a traditionally rigid climbing tool, among other dissimilarities, the '684 patent's exhibits many limitations. The leather or rubber strap is overly stable whereas various embodiments discussed below more accurately mimic tool placement, tool pressure, and body positioning in ice climbing or dry tooling embodiment. Further, the leather loop device from the '684 trains only the hand grip whereas various embodiments discussed below can train both the hand grip, define accurate tool placement, replicate tool pressure to a wall, as well as improvements to body positioning during use. And, because the tool is also limited by the designs of the hold itself which do not accurately relate to the interconnection of a traditional tool with ice or rock, the climbing tool of the '684 patent is also further limited by the hold to which the tool's flexible band connection can be made.

DESCRIPTION OF EMBODIMENTS ILLUSTRATING THE INVENTION

Figure 1:
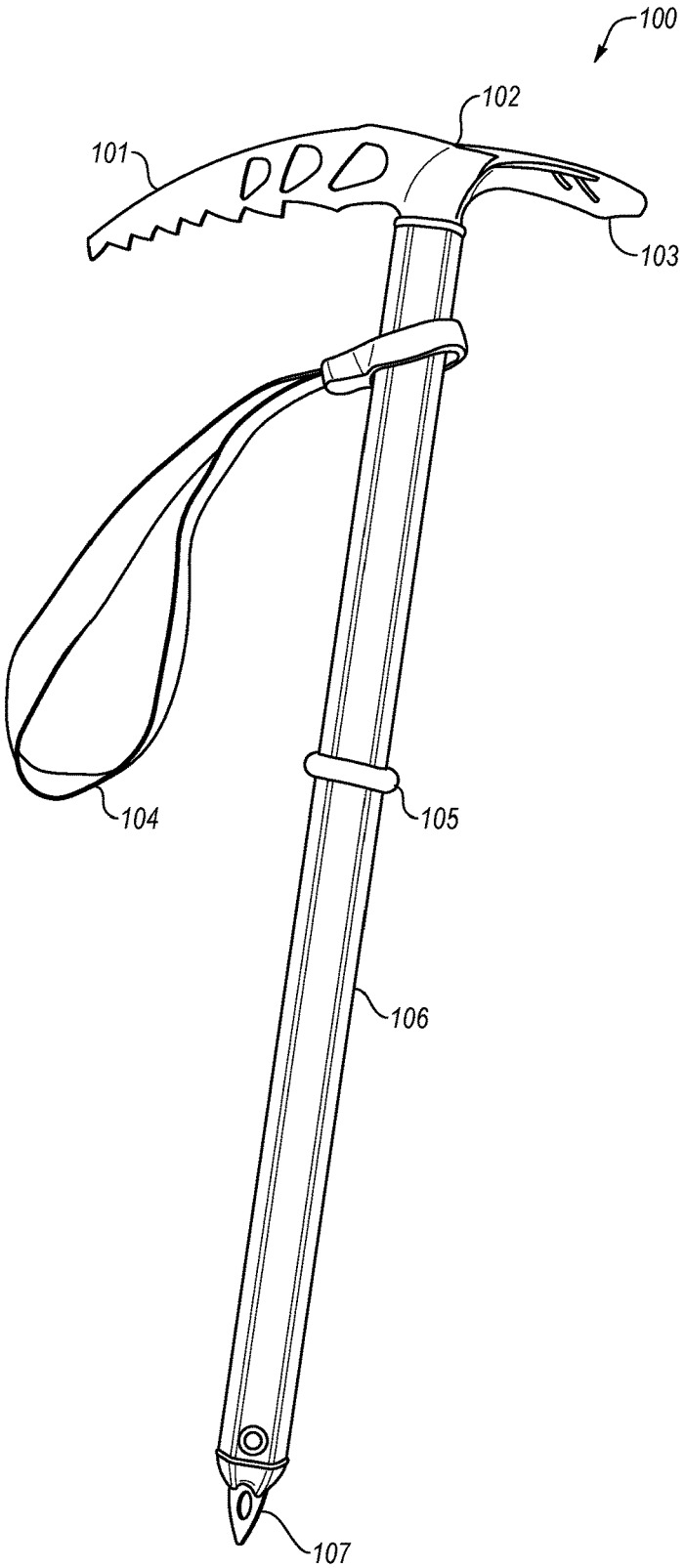
FIG. 1 (Prior Art)
FIG. 1 illustrates a common mountaineering ice axe.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The various teachings and embodiments discussed in this description by the inventor are illustrative of obstacle systems, components thereof, and related devices. The various systems can be inspired by traditional mountaineering and ice climbing as well as other activities, obstacles, and problems. The systems and devices can be use indoors and/or outdoors and can be associated with a vertical or partially-vertical climbing surface or wall. A climbing wall, for example, can include inclines, volumes, and different climbing routes. And, the climbing system components, devices and apparatus can be combined with other climbing apparatus, holds, volumes, features, problems, devices, and systems.

Several embodiments disclosed herein include a full size dry tooling/ice climbing training device. For example, referring to FIGS. 2A and 2B a climbing apparatus 200 is illustrated. The climbing apparatus 200 includes a handle 205 and an anchoring appendage 210. The anchoring appendage 210 extends at an acute angle 220 less than 85 degrees relative to the handle 205. The anchoring appendage 210 can be described as a substantially cylindrical peg having a cylindrical axis of revolution about a centerline thereof. The acute angle 220 of less than 85 degrees can be measured between this axis 210A of the anchoring appendage 210, or other linear feature, of the anchoring appendage 210 and a centerline, axis, surface plane, or approximate mid-line 205C of the handle 205.

An end 215 of the anchoring appendage 210 can be flat. The end 215 of the anchoring appendage 210 can be blunt, or substantially blunt. The flat or blunt end 215 of the anchoring appendage 210 can be designed to avoid sharp edges, points or other abrupt changes in geometry so as to make the likelihood of an intensified impact of a surface to the tip of the end 215, or other portion of the anchoring appendage 210, less dangerous. The anchoring appendage 210 can also be defined by a tapered, cone-shaped, non-linear, or other predetermined outer cross-sectional shape as the anchoring appendage 210 extends along its length 250.

The acute angle 220 between the anchoring appendage 210 and the handle 205 can be less than, or about 80 degrees, 75 degrees, 70 degrees, 65 degrees, 60 degrees, 55 degrees, 50 degrees, 45 degrees, 40 degrees, 30 degrees, 25 degrees, 20 degrees, or less than about 15 degrees. According to the embodiment shown in FIG. 2B, the acute angle 220 between the anchoring appendage 210 and the handle 205 can be between 20 and 50 degrees, or between 30 and 40 degrees. According to the example embodiment shown in FIG. 2A, the acute angle 220 between the anchoring appendage 210 and the handle 205 can be between 20 and 85 degrees, more preferably between about 30 and 40 degrees.

Figure 2A:
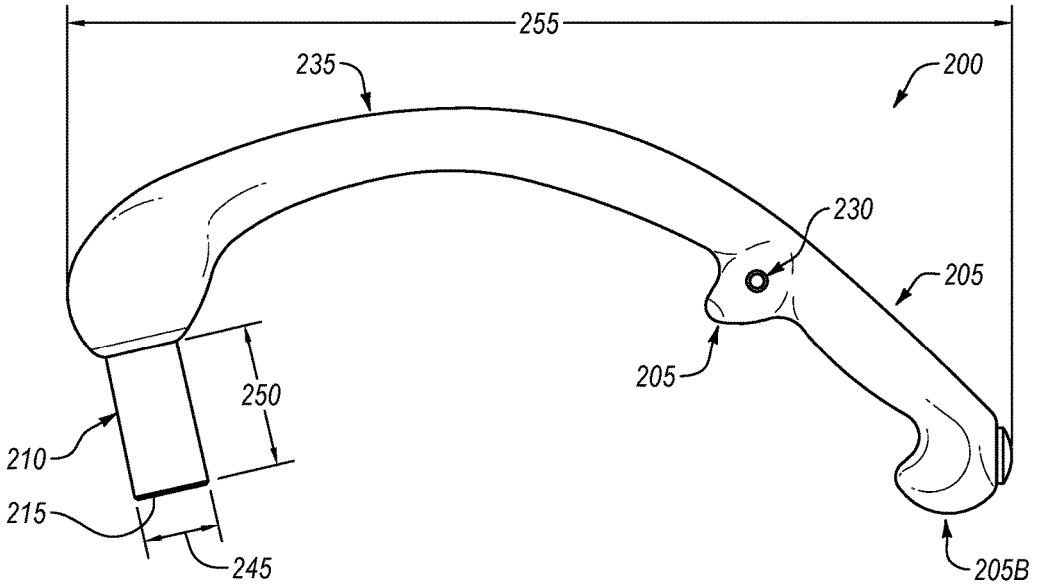
FIGS. 2A-2B illustrate a climbing apparatus.

The handle 205 can be defined by a top protrusion 205A and a bottom protrusion 205B of the handle 205 between which the handle 205 is grasped. The climbing apparatus 200 can include a leash attachment feature 230, such as a hole or clip for attaching a leash (not shown) thereto. For example, a ⅜ inch hole located at a mid-section of the handle 205 or elongate member can accept a 4 mm accessory cord which will act as a leash catching the climbing apparatus 200 from dropping to the ground. In FIG. 2A, the leash attachment feature 230 can be a hole for threading a leash there through. In the embodiment shown in FIG. 2A, the leach attachment feature 230 can be located near the top 205A of the handle 205, while other locations such as the bottom 205B of the handle 205 can be suitable locations for attaching a leash. The leash can be used to capture the climbing apparatus 200 should the climber loose a grip of the climbing apparatus 200 preventing the climbing apparatus 200 from being dropped or otherwise lose control thereof.

Figure 2B:
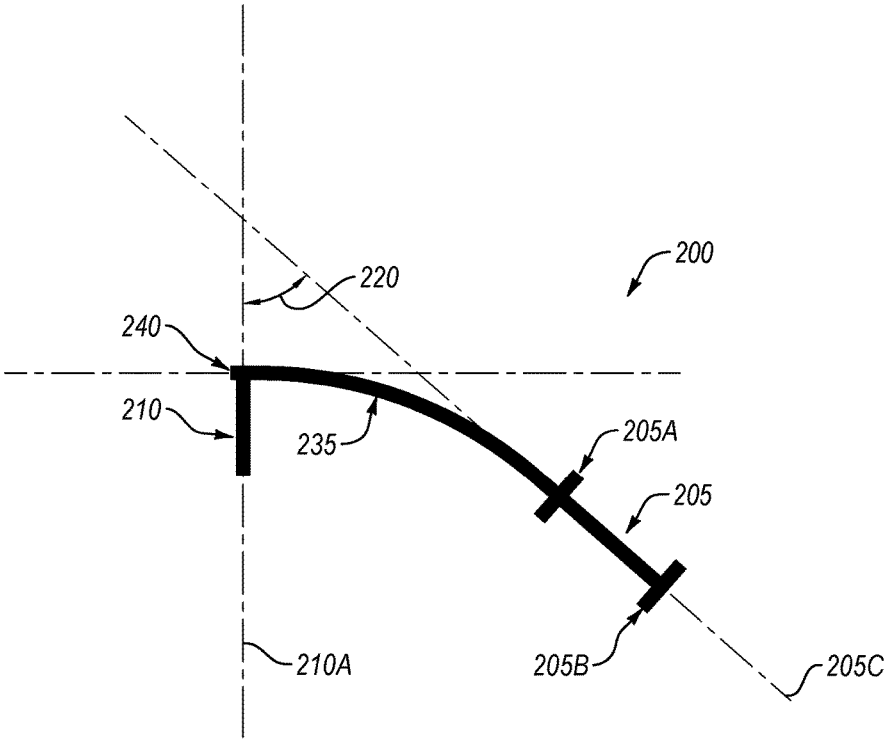

The handle 205 and anchoring appendage 210 of the climbing apparatus 200 can be connected or coupled to one another by a connection or support member. For example, as shown in FIG. 2A and FIG. 2B, the handle 205 can be connected to the anchoring appendage 210 by an elongate member 235. The elongate member 235 can be straight, curved or a combination thereof. For example, the elongate member 235 coupling the anchoring appendage 210 to the handle 205 can be curved as shown in FIG. 2A and FIG. 2B. The elongate member 235 can be continuously curved as shown or the elongate member 235 can include a straight portion proximate to the handle 205 and/or proximate to the anchoring appendage 210, or at one or more locations there between.

The intersection between the anchoring appendage 210 and the elongate member 235 can be referred to as the head 240 of the climbing apparatus 200. The head 240 of the climbing apparatus 200 can also refer to an end of the elongate member 235 proximate to the anchoring appendage 210 in combination with the anchoring appendage 210. Thus, the climbing apparatus 200 can also be referred to as an "artificial climbing axe".

Where the handle 205 and anchoring appendage 210 are attached to one another via the curved elongate shaft 235 as shown in FIG. 2A, the acute angle 220 shown in FIG. 2B between the anchoring appendage 210 and the handle 205 may be smaller as opposed to where the handle 205 and anchoring appendage 210 are attached to one another by a straight elongate shaft 235. This is because the elongate shaft 235 is curved away from the anchoring appendage 210 in such embodiments allowing additional engagement access to the anchoring appendage 210 as shown in FIG. 2A.

The entire climbing apparatus 200 illustrated in FIG. 2A is substantially rigid according to various preferred embodiments. For example, the handle 205, anchoring appendage 210, and elongate member 235 can be made of one or more substantially rigid materials. The handle 205, anchoring appendage 210, and elongate member 235 can be unitarily formed or independently made, individually formed, coupled, and/or attached together. Nevertheless, the climbing apparatus 200 can be substantially rigid so as to allow a climber to hang from the handle 205 of the climbing apparatus 200 without causing substantial deformation to the climbing apparatus 200.

The materials of the climbing apparatus 200 can be substantially resistant to deformation, neither substantial plastic nor substantial elastic deformation. For example, the climbing apparatus 200 can resist tensile, compressive, shear, bending or torsional deformation under the weight of a climber. For example, a climber can be between about 50 and 250 pounds in weight, or preferably between about 100 and 200 pounds for an adult climber while other human adult weights are known by anthropometric reference data for children and adults which is periodically released by the National Health Statistics Reports and includes data for various weights and body dimensions. One example of human limb dimensional data is the National Health Statistics Reports, Number 10, Oct. 22, 2008 available at http://www.cdc.gov/nchs/data/nhsr/nhsr010.pdf, the contents of which are well known and hereby incorporated by reference herein. That is, the anchoring appendage 210 is preferably entirely non-elastic under the body weight of an adult, child, or for a particular person for which it is designed. The anchoring appendage 210 may be made of wood, plastic, or metal. The anchoring appendage 210 may be devoid of rubber. And, in some embodiments, the entire combing apparatus 200 may be devoid of rubber or other substantially elastic material. In some embodiments, the handle 205 or other portions may include rubber for comfort and grip purposes, for example.

The anchoring appendage 210 can be affixed to the elongate member 235 and substantially immovable relative thereto. For example, the anchoring appendage 210, elongate member 235, and handle 205 can be referred to independently or collectively as being solid or a substantially solid apparatus as opposed to being elastic, pivotable, stretchable or otherwise displaceable in any manner with respect to one another. As such, the anchoring appendage 210 can be referred to as being directly affixed to the elongate member 235 and/or handle 205.

In some embodiments, the anchoring appendage 210 is made from wood, metal, hard plastic or a combination thereof. As discussed below, the anchoring appendage 210 can be made of a material encapsulating another material whereby the material may be considered a composite of materials. The composite material may include a wood or plastic material surrounding a metallic material. The composite material may include a radially inward material, or more centrally located material and an outer material. The outer material can be referred to as a shell or covering. Or the inner material can be referred to as an endoskeleton, structure, or strut. The inner material may be used to promote support and/or rigidity for the outer material. The outer material can include various tactile, wear, reusable, replaceable, or other features associated thereto.

The anchoring appendage 210 can be selected based on a thickness 245 thereof. The thickness 245 can be selected based on a weight of a climber for which the climbing apparatus 200 is designed. The thickness 245 or cross-sectional shape of the anchoring appendage 210 can be selected based on a climbing wall design, slope, or problem to which the particular anchoring appendage 210 is associate with. For example, the thickness 245 of the climbing appendage 210 can be between about 1 and 6 centimeters. As illustrated in FIG. 2A, the thickness 245 of the anchoring appendage can be between about 2 and 4 centimeters, or about 3 centimeters.

The length 250 of the anchoring appendage 210 can also be varied according to various criteria. And, a selection of different climbing apparatus 200 with different length 250, width 245, and shapes of anchoring appendages 210 may be provided. The length 250 of the anchoring appendage 210 can be between about 1 and 16 centimeters. As illustrated in FIG. 2A, the length 250 of the anchoring appendage 210 can be between 4 and 10 centimeters, between about 6 and 8 centimeters, or about 7 centimeters. The length 250 of the anchoring appendage 210 can be measured from where the anchoring appendage 210 meets the elongate member 235, for example. The anchoring appendage 210 may, however, extend into the elongate member 235 so as to be over molded and connected to the elongate member 235 or become part of the elongate member 235 as discussed herein.

A measured length 255, or "footprint" of the climbing apparatus 200 can be selected to provide a range of reach appropriate for the climber to reach a plurality of locations, routes, problems, and other areas of the climbing wall, and the location of the various problems, holds and features of the climbing wall be selected based on the measured length 255 of the climbing apparatus. The length 255 of the climbing apparatus 200 can be selected based on the size, weight, and skill of the climber and a selection of different lengths and other attributes may be provided to the climber based on the climber's preference or particular problems to which the climbing apparatus is to be applied.

For example, the length 255 of the climbing apparatus 200 can be between 20 and 70 centimeters. The length 255 shown in FIG. 2A can be about 42 centimeters. Examples of shorter and longer climbing apparatus can be between about 25 and 50 centimeters with a shorter embodiment having a length of about 24-30 centimeters, for example. Other lengths 255 of climbing apparatus 200 can be used and will also depend on attributes of the handle 205, angle 220 of the anchoring appendage 210, and curvature, partial curvature, or lack of curvature, of the elongate member 235, for example.

According to the example of FIG. 2A the length 255 of the climbing apparatus 200 can be about 40-44 centimeters, the length 250 of the anchoring appendage can be about 7-8 centimeters, and the width 245 of the anchoring appendage can be about 2.5 to 3.5 centimeters.

Figure 3B:
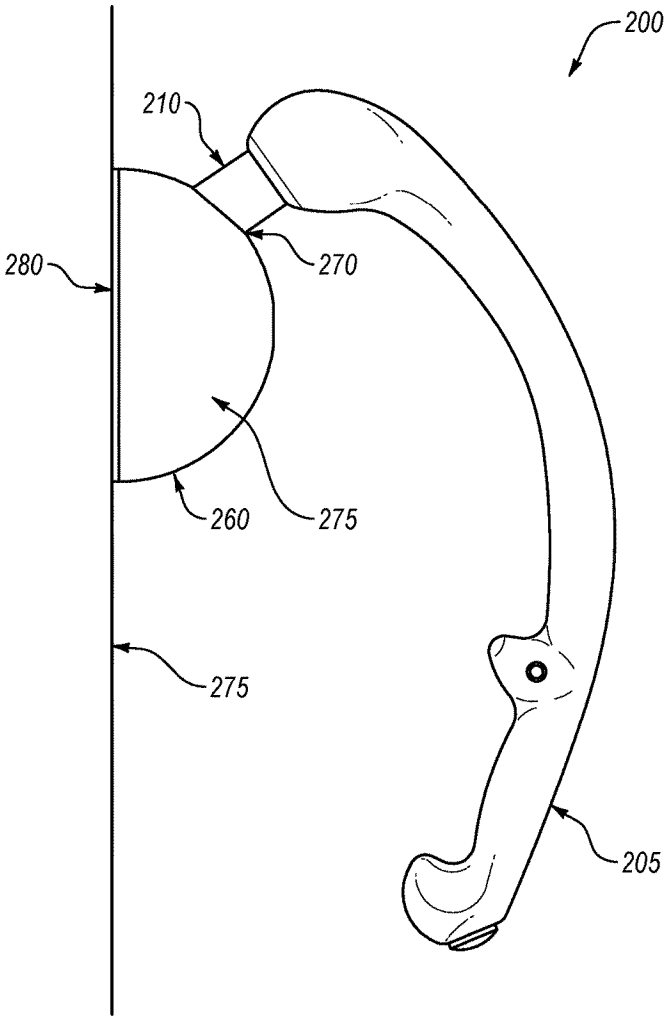
FIGS. 3A and 3B illustrate a climbing system including the climbing apparatus and an anchor receiver.
Figure 3A:
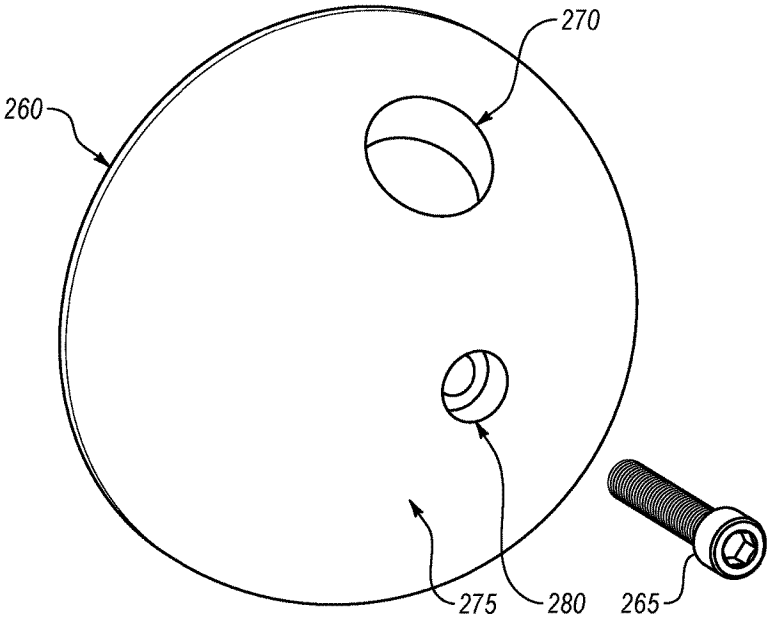

As shown in FIG. 2B and FIG. 3A, the climbing system can further include an anchor receiver 260. The anchor receiver 260 is configured to be attached to, supported by, and/or coupled with a climbing wall. The anchor receiver 260 can include means 265 280 for attaching the anchor receiver to the climbing wall. The means 265 280 for attaching the anchor receiver 260 to the wall can include a screw, bolt 265, latch, hanger, or other mechanical attaching device. The screw can be a wood or concrete type screw with a head and threads. The bolt 280 can include a head, shaft and threads. The means 265 for attaching the anchor receiver 260 to the climbing wall can include one, two, or more, ⅜-16 sized bolts of various lengths and may have an Allan head as is well known in the art of climbing walls. Thus, the anchor receiver 260 may be attachable to conventional or special purpose climbing walls according to the means 265 for attaching the anchor receiver 260 to the climbing wall.

The anchor receiver 260 includes an aperture 270. The aperture 270 can be designed to correspond to the anchoring appendage 210 of one or more particular climbing apparatus 200 as illustrated in FIG. 3B. The aperture 270 can include a void, slot, indentation or other aperture 270 shape that corresponds with an outer shape or perimeter attributed of the anchoring appendage 210 of a climbing apparatus 200. The aperture 270 of the anchor receiver 260 can be designed to temporarily secure the climbing apparatus 200 to the anchor receiver 260 while a climber is suspended on the climbing wall 275.

The aperture 270 of the anchor receiver 260 can be substantially cylindrical in cross sectional shape. The substantially cylindrical aperture 270 can be a cylindrical void. The cylindrical void can be defined by an axis around which the cylindrical void extends. The cylindrical void can be defined by a depth. And, the width and depth of the cylindrical void of the aperture 270 can be associated with a diameter and length of an anchoring appendage 210 of a climbing apparatus 200 for which the cylindrical aperture 270 is designed. For example, an aperture 270 and anchoring appendage 210 can be designed together to be interoperable with one another so as to temporarily secure the anchoring appendage 210 to the anchoring aperture 270 when the anchoring appendage 210 is inserted into the anchoring aperture 270 of the anchor receiver 260.

When the anchoring appendage 210 is temporarily secured to the anchoring aperture 270 of the anchor receiver 260, the climber is allowed to at least partially support the weight of the climber by holding onto the handle 205 of the climbing apparatus 200. According to various preferred embodiments, all of the structural components of the climbing apparatus 200 and the anchor receiver 260 are rigid. Therefore, in such embodiments, the interconnection with the anchor receiver 260 and the climbing device 200 can also be substantially rigid. According to the embodiment of the anchor receiver 260 illustrated in FIG. 3A and FIG. 3B, the anchoring appendage 270 is cylindrical and only allowed to rotate about its axis within the anchoring aperture 270. But, the anchoring appendage 270 is restricted from pivoting about its length. Thus, the climbing apparatus 200 is only rotatable about the axis 210A (see FIG. 2B) of the anchoring appendage 210 but is not angularly movable with respect to the axis of the anchoring appendage 210 nor about the axis of the cylindrical void of the anchoring aperture 270 according to such embodiments.

Regarding the example of an anchor receiver 260 illustrated in FIG. 3A and FIG. 3B, the climbing wall 275 anchor receiver 260 can include an anchoring mass 275. The anchoring mass 275 can be defined by a shape, such as a half-dome shape as illustrated in FIG. 3A and FIG. 3B. The half-dome shape can be considered a fractional, such as a half of a circle, or multiple half-dome. Other shapes of anchor receivers 260 can include square, rectangular, partially spherical, curved planar, linear planar, complex, and/or other combinations of curved and/or planar exterior surfaces.

The anchoring mass 275 of the anchor receiver 260 can include a planar surface 280. The planar surface 280 of the anchoring mass 275 can be designed to abut the planar surface of the climbing wall 275. Other surfaces of an anchoring mass 275 can be included such as mechanical locating or key features so as to mechanically locate the anchoring mass 275 upon the climbing wall 275 or in connection with another object. According to the embodiment illustrated in FIG. 3B the planar surface 280 of the anchoring mass 275 is entirely flat so as to lay flush with the planar surface of the climbing wall 275 and resist tilting, shifting, pivoting, or other movement when the anchor receiver 260 is affixed to the climbing wall 275 via the attachment means 265 thereby remaining substantially stationary and resisting movement relative to the climbing wall 275.

The climbing wall anchor receiver 260 can include a channel 280 as part of an attachment means extending through the anchoring mass 275 for receiving the means 365 for securing the anchor receiver 260 to the climbing wall 275. The means 265 for securing the anchoring device 260 can include a fastener, such as a bolt, as previously discussed. The channel 280 can be sized so as to closely receive the attachment means 265 therein thereby resisting movement of the bolt 265 relative to the channel 280 perpendicular to their common central axis. Thus, a diameter of the channel 280 can closely conform to a diameter of a bolt 265 designed to extend thereto and affix the anchoring mass 275 of the climbing wall anchor receiver 260 to the climbing wall 275. Thus, where the anchor receiver 260 is defined by a half-dome-shape, the channel 280 can be defined as extending through a center of the half-dome of the anchor mass 275. The center of the half-dome can be defined by a circular outer perimeter of the half-dome shaped mass 275, and the center of the half-dome can be defined as the thickest portion between the planer surface and the apex, or point of furthest distance from the plane, of the half-dome.

Any attribute of the anchor receiver 260 or climbing apparatus 200 can be modified so as to change an angular engagement between the climbing apparatus and a climbing wall. Moreover, a plurality of different climbing apparatus and/or anchor receivers can be provided to utilize different relative angles, distances, and positioning between the handle of the climbing apparatus and the climbing wall.

Figure 4A:
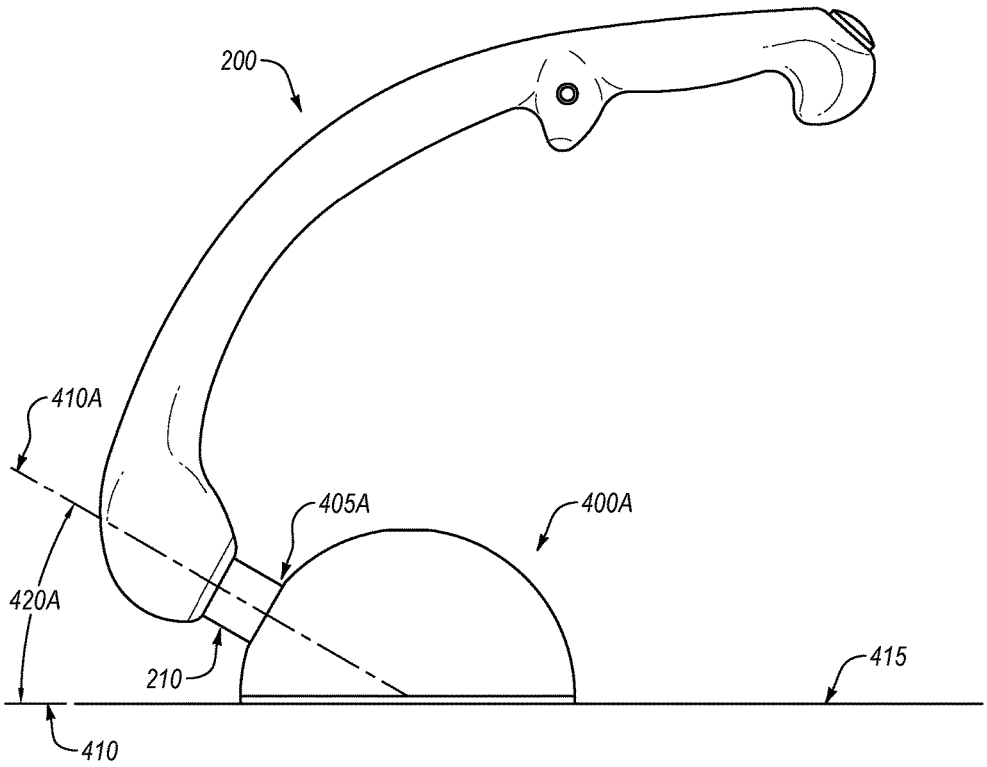
FIGS. 4A and 4B illustrate different anchor receivers with different anchor angles.
Figure 4B:
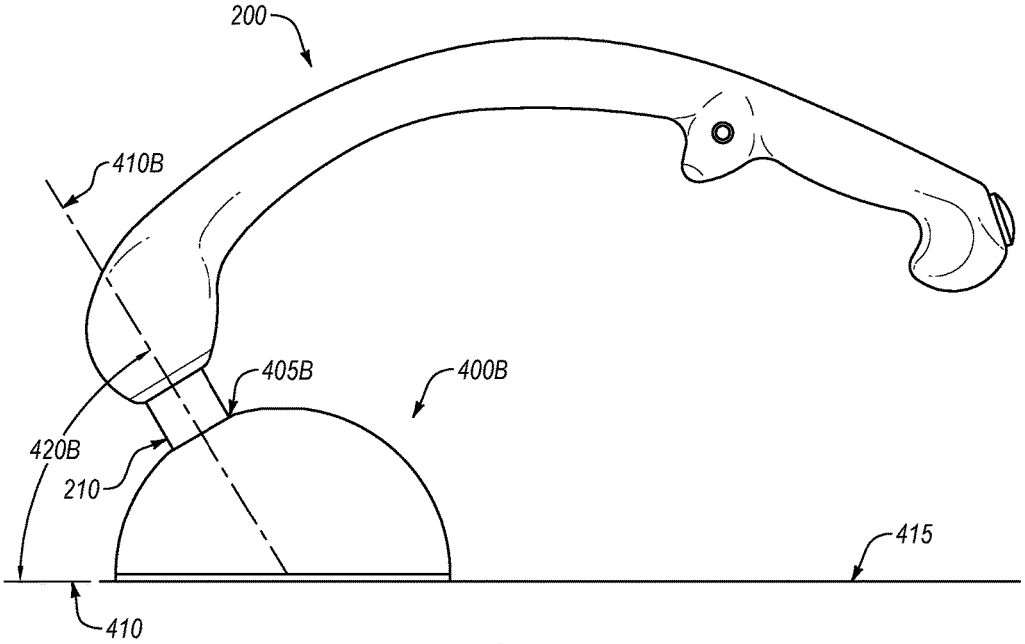

For example, referring to FIG. 4A and FIG. 4B two different anchor receivers 400A and 400 B are shown respectively. FIG. 4A illustrates an anchor receiver 400A including an anchoring aperture 405A defined by an aperture axis 410A. FIG. 4B illustrates an anchor receiver 400B including an anchoring aperture 405B defined by an aperture axis 410B. As shown by a comparison of FIG. 4A to FIG. 4B, the aperture axis 410A is disposed at a different angle 420A relative to a plane 410 of a climbing surface 415 as opposed to aperture axis 410B and angle 420B.

The anchor axis 410A of the anchor receiver 400A can be defined relative to the plane 410 of the climbing wall surface 415 as shown in FIG. 4A. Similarly, the anchor axis 410B of the anchor receiver 400B can also be defined relative to the plane 410 of the climbing wall surface 415 as shown in FIG. 4B. As such, the anchor receiver 400A can be described as being associated with an anchor angle 420A as shown in FIG. 4A and the anchor receiver 400B can be described as being associated with an anchor angle 420B as shown in FIG. 4B.

The anchor angle 420B of anchor receiver 400B can be larger than the anchor angle 420A of anchor receiver 400A. The anchor angle 420B can also be described as more obtuse to anchor angle 420A. And, anchor angle 420A can be described as being more acute to anchor angle 420B. Anchor angles can be unique to the climbing apparatus which differ from standard peg board mechanics where the dowel is desired to be level with the ground. The climbing apparatus can require a 20 degree incut, for example. Examples of anchor angles can be between 10 and 80 degrees. For example a set of anchor receivers can be provided with different anchor angles in increments of five degrees between 10 and 80 degrees.

Figure 5:
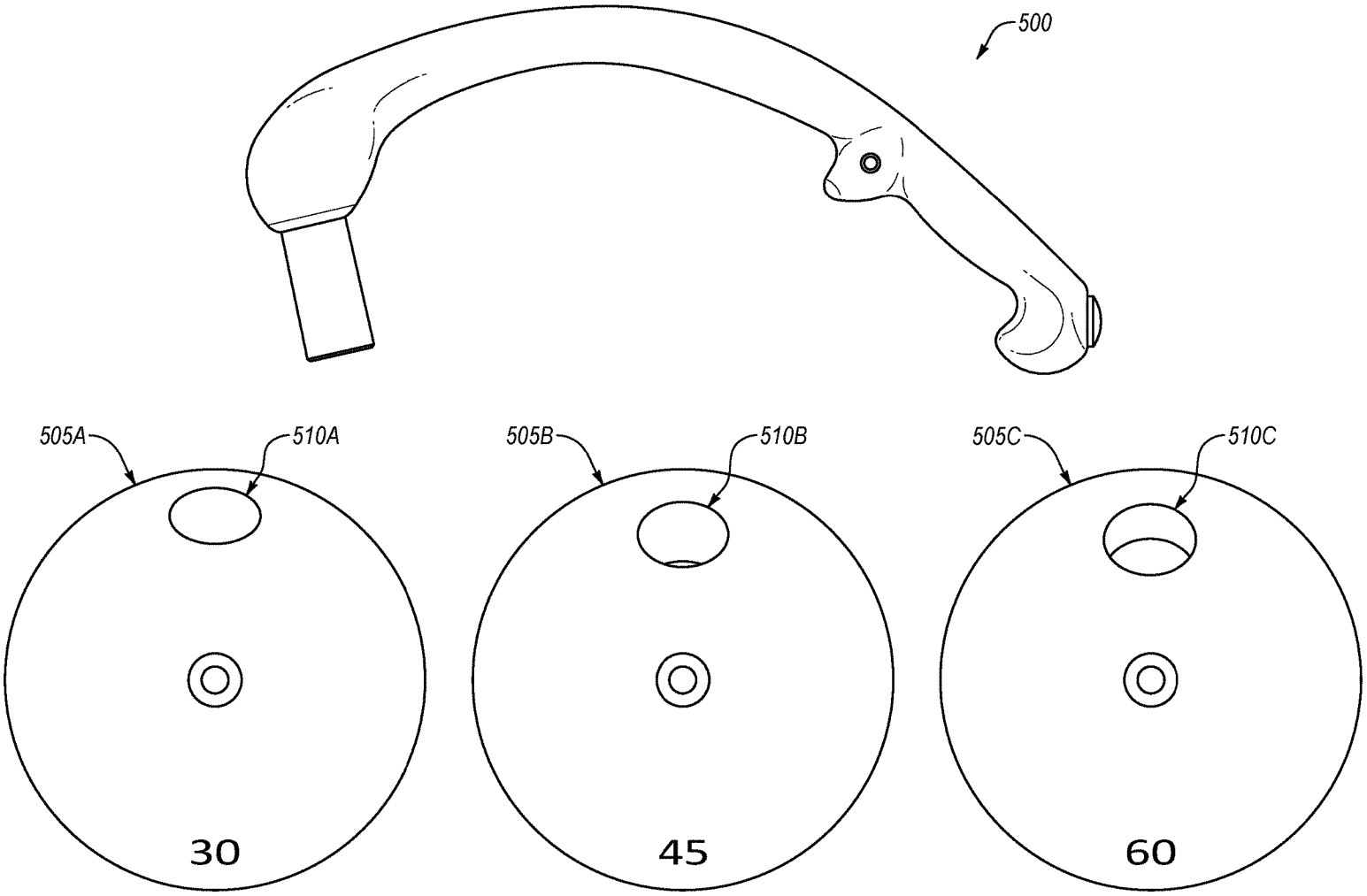
FIG. 5 illustrates a climbing system including a set of anchor receivers with different anchor angles.

Referring to FIG. 5, a climbing system is illustrated including a climbing apparatus 500 and a plurality of anchor receivers 505A-C. In this example, the anchor receivers

505A-C have apertures 510A-C with different aperture attributes. According to the example illustration of FIG. 5, a first anchor receiver 505A is associated with a first anchor aperture 510A, a second anchor receiver 505B is associated with a second anchor aperture 510B, and a third anchor receiver 505C is associated with a third anchor receiver 510C.

For example, the anchor aperture 510A can be associated with an anchor angle of 30 degrees, the anchor aperture 510B can be associated with an anchor angle of 45 degrees, and the anchor aperture 510C can be associated with an anchor angle of 60 degrees. Thus, in this example, a set of anchor receivers is provided with a incrementally increasing anchor angle of 15 degrees. Other sets of two or more anchor receivers with incrementally increasing anchor angles can be provided according to the teachings disclosed by the inventor herein. The anchor receiver can include a 6 inch half-dome with 4 different angled 1 5/16 inch holes, for example. The anchor in-cut angle of the apertures 510A-C can vary to accommodate different terrains to which the anchor receiver is to be attached. The angles are unique to the try tooling climbing apparatus, which differs from standard peg board mechanics where a dowel is desired to be level with the ground. In this example, the climbing apparatus 500 requires at least about a 20 degree in cut anchor angle to remain stable as opposed to conventional peg board designs.

According to various innovative combinations, subcomponents, devices and methods disclosed herein, an anchor receiver can include a plurality (i.e. two or more) of anchor apertures. The plurality of anchor apertures can be rotationally disposed about a center point. The center point can be a center point of an anchor receiver. And, the center point of the anchor receiver can be a fixture about which the anchor receiver is rotated. The fixture can be a means for attaching the anchor receiver to a climbing surface. A climbing surface can be a climbing wall having differently angled surfaces thereof. And, selection of one or more anchor apertures can be based on an angle of the climbing surface to which the anchor receiver is attached.

According to several embodiments, the angle of the surface to which the anchor receiver is to be attached can be used to select an anchor angle of the anchor receiver. According to the embodiment previously discussed reference to FIG. 5 a particular anchor receiver 505 is selected based on the anchor axis of its anchor aperture. However, according to various other embodiments disclosed herein an anchor receiver can have multiple different selectable anchor apertures defined by different anchor angles or other attributes that define an orientation of a climbing apparatus when used together.

Figure 6A:
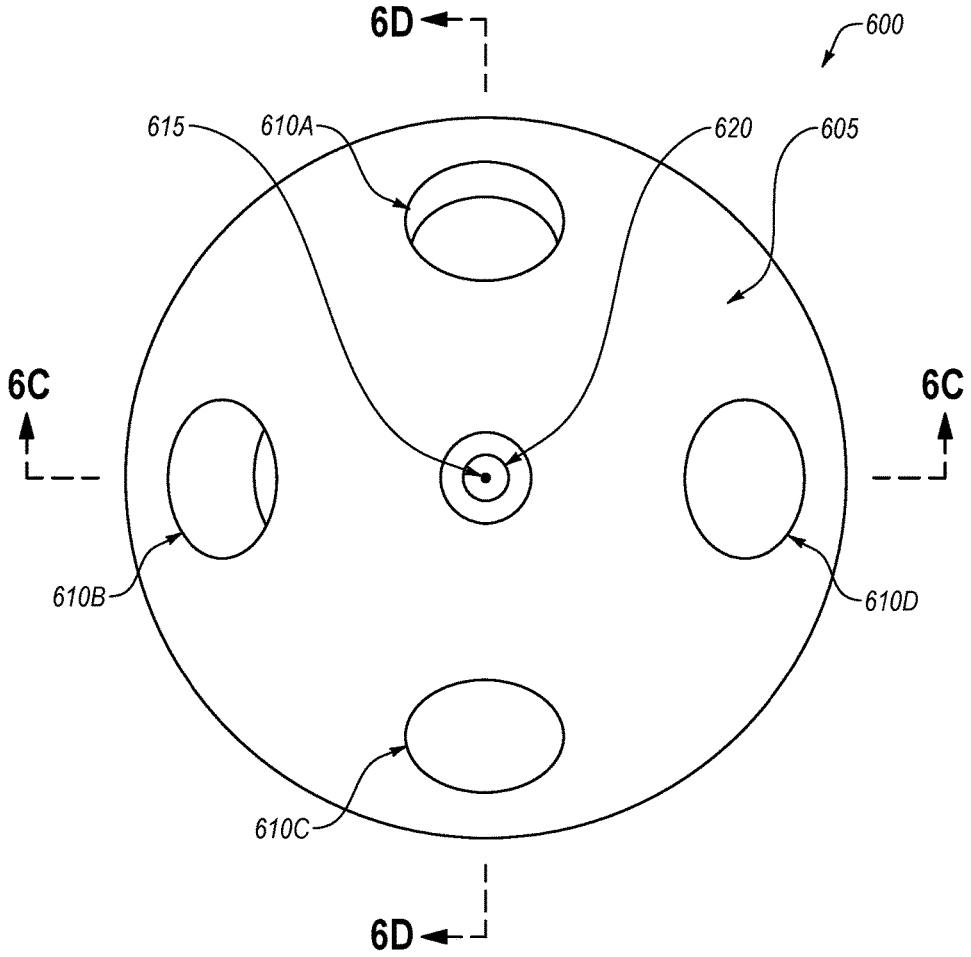
FIGS. 6A-6E illustrate an anchor receiver with multiple radially rotatably selectable anchor apertures.

For example, referring to FIGS. 6A-6D an example of an anchor receiver 600 is illustrated. As shown in FIG. 6A, the anchor receiver 600 includes an anchor mass 605 and a center point 615. However, the anchor receiver 600 includes a plurality of anchor apertures 610A-D. The plurality of anchor apertures 610A-D can include at least two anchor apertures 610 or in this example four anchor apertures 610. Other embodiments can include three, five, or more anchor apertures 610 and the embodiment shown in FIG. 6A is illustrative of an example of a dome shaped anchor receiver 600 including four anchor apertures 610.

The climbing wall anchor receiver 600 includes an anchoring mass 605. The anchoring mass 605 includes the plurality of anchoring apertures 610A-D. According to the embodiment illustrated in FIG. 6A, the climbing wall anchor receiver 600 includes four anchoring apertures 610A, 610B, 610C, and 610D. Each anchoring aperture 610 is sized and shaped for receiving a corresponding anchoring appendage. While the size and shape of anchoring appendage for which the anchoring apertures 610 are designed may be different, in the embodiment illustrated in FIG. 6A, the size and shape of anchoring appendage for which the anchoring apertures 610 are designed is similarly sized and shaped.

The anchor receiver 600 further includes a channel 620 having a centerline 615. The channel is sized and configured to receive a fastener (not shown—e.g. see FIG. 3C and bolt 265). The channel 620 can include a recessed portion for receiving a head of the fastener and the center of the centerline 615 of the channel 620 can correspond with a centerline of a circular outer perimeter of the anchor receiver 600 as illustrated in FIG. 6A. Thus, the centerline 615 can be described as a centerline 615 of the outer perimeter of the half-dome shaped anchor receiver 600, a centerline 615 of the channel 620, and a centerline of a cylindrical interior shape defined by the channel 620. Thus, the centerline 620 can be defined as an axis of the channel 620 or cylindrical shape thereof.

Figure 6B:
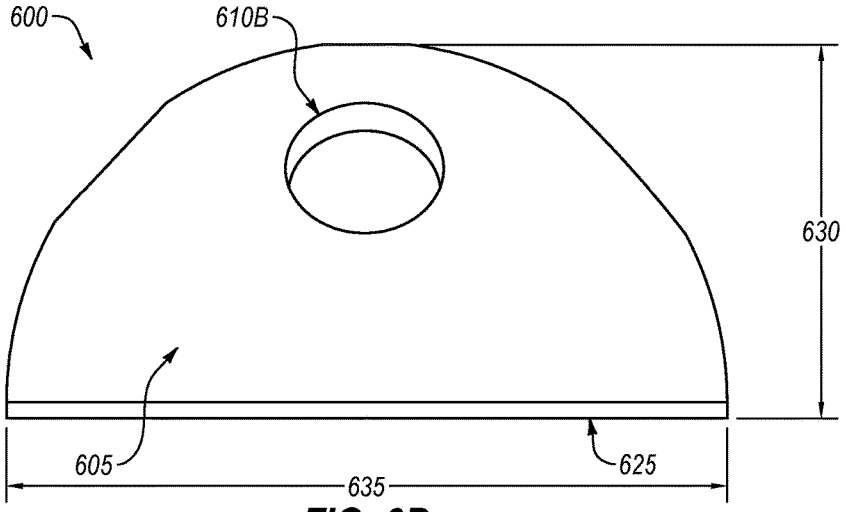

Referring to FIG. 6B, the anchor receiver 600 includes a planar surface 625. During use, the planar surface 625 of the anchoring mass 605 that abuts a surface of a climbing wall when a fastener extends through the anchoring mass to mechanically affix the anchor receiver 600 to the climbing wall having the planar surface 625 flush there against.

Referring again to FIGS. 6C and 6D, the anchoring apertures 610 are disposed in the anchor receiver 600 at different anchor angles 640 relative to the planar surface 625 of the anchoring mass 605. According to the embodiment illustrated in FIGS. 6A-6D, each of the plural of anchoring apertures 610 are defined by a substantially cylindrical sidewall having a centerline to which the anchor angles 640 are measured. The centerline of each aperture 610 is disposed at different anchor angle 640 relative to the planar surface 625. This difference of anchor angle 640 can be designed to accommodate a different angle of climbing wall surface to which the anchoring device 600 is to be attached. The different anchor angles 640 can also be used to complicate or variate attributes and problems associated with one or more climbing routes, to accommodate different climbers, devices, or for other purposes.

Figure 6C:
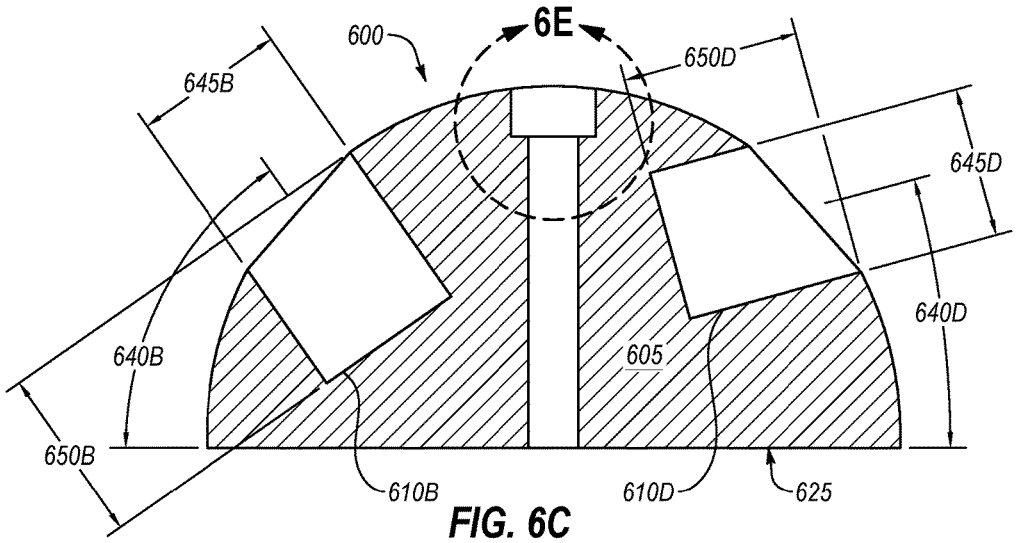
Figure 6D:
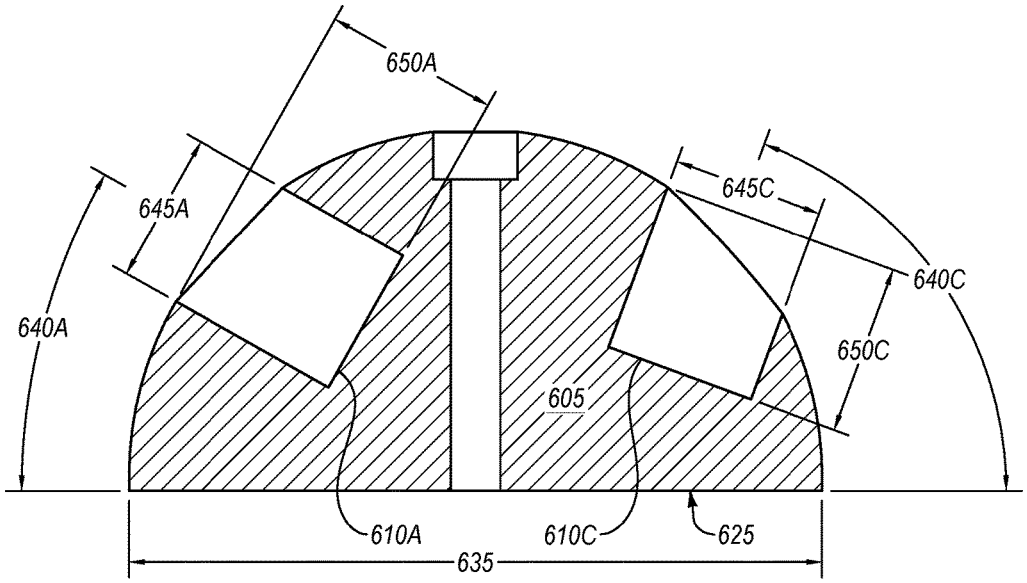

With particular reference to FIGS. 6A, 6C, and 6D the anchor receiver 600 is rotatable about the centerline 615 of the channel 620 so as to selectable orient an upper-most aperture 610 having a centerline anchor angle 640 depending on different surface angles of a climbing wall to which the anchoring device 600 is to be attached. Thus, the anchor receiver 600 can be oriented with one of anchor apertures 610A, 610B, 610C, or 610D oriented in an upper-most position, at which point the anchor receiver 600 is positionally affixed to the particular climbing surface of a climbing wall using fastening means. Thus, the fastening means can also be referred to as means for rotationally securing the anchor receiver 600 to a climbing wall. Similarly, a particular anchor aperture 610 may be selected, the anchor receiver 600 may be rotationally position so as to orient the selected aperture 610 in an upper-most position. And, the anchor receiver 600 can be mechanically secured to the climbing wall so as to substantially prevent rotational and translational movement of the anchor receiver 600 relative to the climbing wall.

As shown in FIGS. 6A-6D, the anchoring mass 605 can be substantially half-dome shaped. The channel is disposed in a center-most position of the half-dome extending through the anchoring mass 605 perpendicular to the planar surface 625 of the anchoring mass 605. The plurality of anchoring apertures 610 are disposed on opposing sides of the anchoring mass. For example, anchoring aperture 610A is located on an opposing side relative to each of 610B, 610C, and 610D. In this embodiment, each of the anchoring apertures 610 is located in one of four different quadrant of the anchoring mass 605.

The four anchoring apertures 610 are each substantially cylindrical shaped and defined by an anchoring aperture center line, the center line of each anchoring aperture 610 being disposed at a different anchor angle 640 relative to the planar surface of the anchoring mass. The centerline from which the anchor angle 640 is measured can be described as an anchor axis. The angle of the center line of each anchoring aperture 610 relative to the planar surface 625 of the anchoring mass 605 is selected from the group of angles: about 5 degrees; about 10 degrees; about 15 degrees; about 20 degrees; about 25 degrees; about 30 degrees; about 35 degrees; about 40 degrees; about 45 degrees; about 50 degrees; about 55 degrees; about 60 degrees; about 65 degrees; about 70 degrees; about 75 degrees; about 80 degrees; and about 85 degrees. For example, the angle of the centerline of the four anchoring apertures 610A, 610B, 610C, and 610D relative to the planar surface of the anchoring mass can be about 10-20 degrees, 25-35 degrees, 40-50 degrees and 55-65 degrees respectively. According to an embodiment, the centerline of the four anchoring apertures 610A, 610B, 610C, and 610D relative to the planar surface of the anchoring mass can be about 15 degrees, 30 degrees, 45 degrees and 60 degrees respectively.

The anchor apertures 610 can be disposed equidistance from the center point 615 of the half-dome shaped anchoring mass 605, or the anchor apertures 610 can be disposed at different polar relationships from the center point 615 of the half-dome shaped anchoring mass 605 including different angular and distance relationships thereto and relatively to other anchor apertures 610.

Referring to FIGS. 6C and 6D, two cross-sectional views of the anchor receiver 600 are illustrated. FIG. 6C is a cross sectional view as seen along cross section perspective plane B-B and FIG. 6D is a cross sectional view as seen along cross section perspective plane A-A. As shown, each anchor aperture 610 is defined by an anchor angle 640 measured between a centerline of each anchor aperture 610 and the anchor plane 625. The anchor plane 625 can be referred to as an anchor mount surface for to which the anchor receiver 600 is mounted to a climbing wall.

Each anchor aperture 610A-D is defined by an aperture width 645A-D and aperture depth 650A-D. For example, aperture 610A is defined by an aperture width 645A and an aperture depth 650A; aperture 610B is defined by an aperture width 645B and an aperture depth 650B; aperture 610C is defined by an aperture width 645C and an aperture depth 650C; and, aperture 610D is defined by an aperture width 645D and an aperture depth 650D.

Each aperture width 645 can be between about 0.25 and 6 centimeters and each aperture depth can be between about 0.25 and 6 centimeters. For example, the aperture width 645 can be between about 2 and 4 centimeters and each aperture depth can be between about 2 and 4 centimeters. According to one embodiment, the aperture width 645 can be between about 3 and 3.5 centimeters and the aperture depth can be between about 3.5 and 4 centimeters. Other depths and widths of anchor aperture 610 attributes can be used. For example, different dimensions of anchor apertures 610 may depend on a particular anchoring aperture to which the anchor aperture 610 is to be temporarily secured. The dimensions of the anchor apertures 610 may also be varied so as to make the anchor apertures 610 conform or closely to, or more loosely fit, the anchor apertures. Thus, the dimensions of the anchor apertures 610 can be designed to allow an anchor aperture to be more tightly secured therein or to enable a looseness of fit. A looseness of fit may be defined by a lack of strict conformity between the interior dimensions of the anchoring aperture relative to the outer dimensions and/or configuration of one or more anchoring appendages.

Figure 6E:
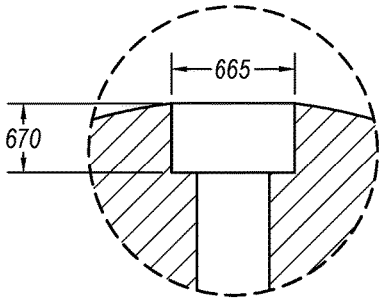

FIG. 6E illustrates section C as defined in FIG. 6C. FIG. 6E illustrates the channel 620 of anchor mass 605 as delineated by cylindrical section plane C. The channel 620 can be defined by the outer dimensions of a fastener, such as a bolt. The fastener can have a head diameter that defines a width 665 and depth 670 of a recessed portion of channel 655. A shaft of a fastener can also define an inner channel diameter 680 of the channel 620. Thus, the dimensions of the inner channel 620 can be defined by a ⅜-16 bolt.

According to various embodiments, the climbing apparatus can include an internal strut. The internal strut can be a structural support for one or more elements of the climbing apparatus. For example, the internal strut can include a single, unitary, and/or common internal support for the anchoring appendage, handle, and/or elongate member. In some embodiment, the internal strut can be a single unitarily formed or connected metallic internal strut for providing rigidity and support to the handle, elongate member and anchoring appendage. For example, the internal strut can be made of a material that is harder than the material of the handle, elongate member, and/or anchoring appendage.

Figure 7:
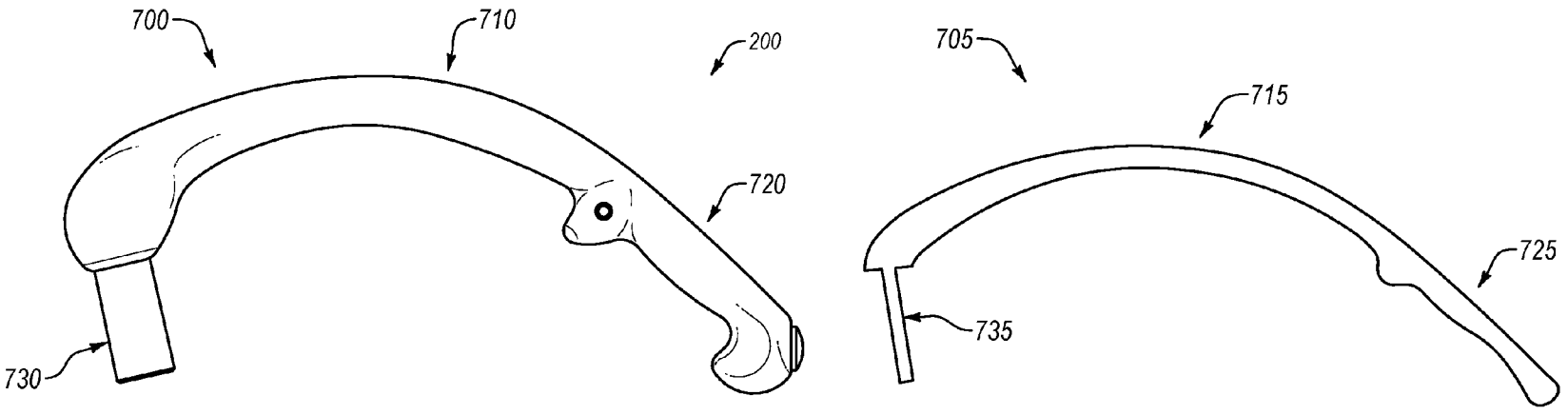
FIG. 7 illustrates a composite climbing apparatus along with an internal support strut.

Referring to FIG. 7 an example of a climbing apparatus 700 and its internal metallic strut 705 is illustrated. The climbing apparatus 700 includes an elongate member 710 and the internal metallic strut 705 includes a corresponding elongate member strut portion 715. The climbing apparatus 700 further include a handle 720 and the internal metallic strut 705 includes a corresponding handle strut portion 725. The climbing apparatus 700 further includes an anchor appendage 730 and the internal metallic strut 705 includes an internal anchor appendage strut portion 735. According to the embodiment shown in FIG. 7, the anchoring appendage 730 can be made of wood, the strut 705 can be made of metal, and the elongate member 710 and handle 720 can be an over-molded polymer.

A climbing apparatus can also include one or more connectable, replaceable, and/or interchangeable parts. For example, referring still to FIG. 7, the anchor appendage 730 can be connectable, replaceable, and/or interchangeable with the elongate member 710. The anchor appendage 730 can include a fastener for attaching the anchor appendage 730 to the elongate member 710. For example, a threaded fitting (e.g. embedded bolt/nut) can be used to rotate and secure the appendage 730 to the elongate member 710. Other means for temporarily or permanently attaching the anchor appendage 730 to the elongate member 710 can be used.

Similarly, the appendage strut portion 735 can be attachable to the elongate member strut portion 715. For example, according to an embodiment of the composite exampled shown in FIG. 7, the appendage strut portion 735 can include male mating threads at an end thereof that mate with corresponding female threads of elongate member strut portion 715 at the abrupt linear transition depicted in FIG. 7. For example, a wooden dowel encapsulating the appendage strut portion 735 can have a threaded bolt portion of the appendage strut portion 735 extending from an end thereof. This threaded bolt fastener of the anchor appendage 730 can mate with and temporarily connect to a threaded bolt portion of the elongate member strut portion 715 of the elongate member 710.

The anchor appendage 730 can also be replaceable with an interchangeable pick (e.g. see element 101 from FIG. 1). For example, a pick can include a bolted threaded portion and be replaceable attached to the elongate member 710. Therefore, a user can attached a pick to the elongate member 710 for outdoor ice climbing use, for example, then replace the pick with a cylindrical anchor appendage 730 for use as previously described regarding a climbing wall.

According to additional embodiments, an existing ice axe can be attached to an anchoring appendage by cutting a slot into an anchor appendage, inserting a pick thereto, and attaching the pick with the anchor appendage to the axe. Thus, the climbing apparatus 200 can functionally include a handle with a dowel as the pick which can be removed for use of the pick itself.

The anchor appendage 730 can also include a multi-use pick embodied by the appendage strut portion 735 that includes an encapsulating cylindrical member 710 that is used to encapsulate the pick embodied by the appendage strut portion. Similarly, the entire end or head of the climbing apparatus can be interchangeable so as to attach an ice climbing pick and/or adaze thereto. Thus, any of the elements of the climbing apparatus 200 can be modular, replaceable, and/or exchanged so as convert the climbing apparatus from a functional ice climbing axe including a pick to the climbing apparatus 200 having the anchor appendage 730 for use with a corresponding anchor receiver.

As previously discussed, the inventions disclosed herein can be directed to various systems, components, devices, and means for accomplishing various functions and purposes. Similarly, various manufacturing procedures, assembly descriptions, and discussions of various methods for design and use of the various inventions disclosed herein have been described.

Figure 8:
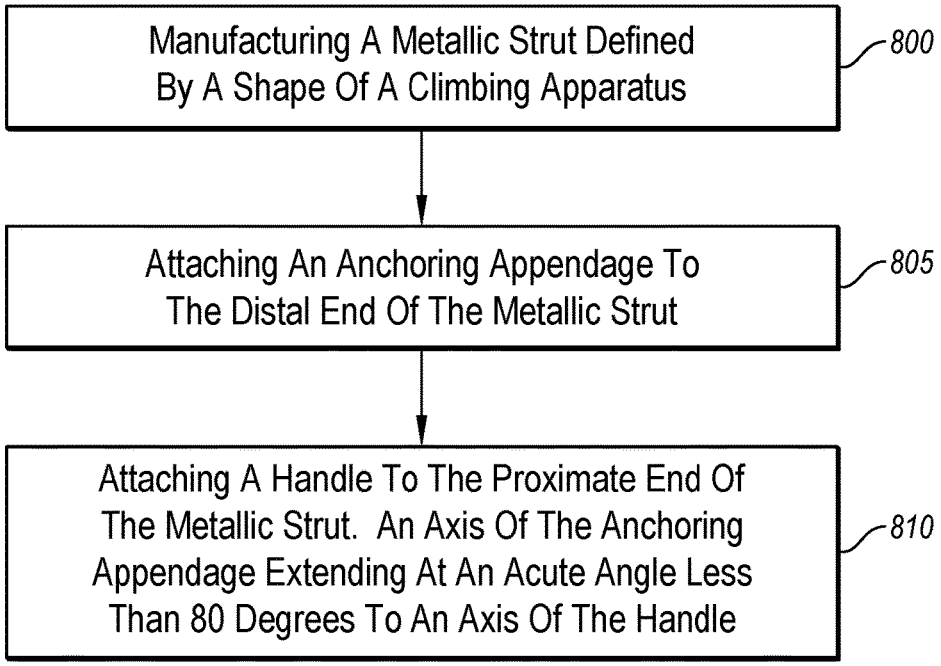
FIG. 8 illustrates a method of manufacturing a climbing apparatus.

For example, referring to FIG. 8, a method of manufacturing a climbing apparatus is illustrated. The climbing apparatus can have the components disclosed herein. The method can include manufacturing a metallic strut (800). The metallic strut can be defined by a shape of the climbing apparatus. The metallic strut can have a distal end and a proximate end. The metallic strut can be cut from a piece of plate metal. Cutting the metallic strut from sheet metal can allow for more complex shapes to be made as opposed to welding and bending processes in some instances. Cutting the metallic strut from sheet metal can also make a unitarily formed and connected strut.

The method includes attaching an anchoring appendage to the distal end of the metallic strut (805). The anchoring appendage can be made of a non-metallic material such as wood. Wood is a particularly advantageous material for an anchoring appendage according to various embodiments as wood has desirable tactile and wear properties for an anchoring appendage. Wood is also readily available in peg-like form to be cut to a desired length, machined, and tailored to various particular applications disclosed herein. Attaching the anchoring appendage to the distal end of the metallic strut includes gluing the anchoring appendage to the distal end of the metallic strut. The anchoring appendage can have a cylindrical cross-sectional shape and be cut from a long piece of cylindrical wood peg.

The method can further include attaching a handle to the proximate end of the metallic strut, an axis of the anchoring appendage extending at an acute angle less than 80 degrees to an axis of the handle (810). Attaching the handle to the proximate end of the metallic strut can include forming the handle around the proximate end of the metallic strut. The handle can be formed round the proximate end of the metallic strut using a molding process. The handle can be made of a polymer and can be formed to encapsulate the proximate end of the metallic strut.

Figure 9:
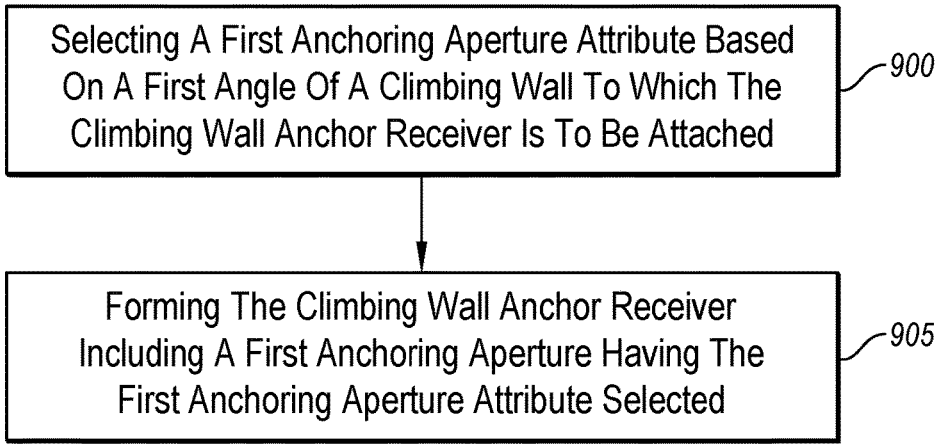
FIG. 9 illustrates a method of manufacturing a climbing wall anchor receiver.

A method of manufacturing a climbing wall anchor receiver is illustrated in FIG. 9. The method includes selecting a first anchoring aperture attribute based on a first angle of a climbing wall to which the climbing wall anchor receiver is to be attached (900). An angle of the wall to which the first anchoring attribute is associated can be subtracted or added to a reference angle to determine the first anchoring attribute. For example, where the base reference angle is 15 degrees and the wall angle is 15 degrees the anchor angle selected for manufacture or placement can be 30 degrees. Where a wall angle is 30 degrees, the selected or manufactured anchor angle can be 45 degrees and so forth.

The method further includes forming the climbing wall anchor receiver including a first anchoring aperture having the first anchoring aperture attribute selected (905). Forming the climbing wall anchor receiver can include forming an anchoring mass including forming the first anchoring aperture for receiving a corresponding anchoring appendage of a corresponding climbing apparatus, and forming a planar surface of the anchoring mass for abutting the climbing wall.

Forming the climbing wall anchor receiver can include forming a channel extending through the anchoring mass for receiving a fastener to mechanically affix the anchor receiver to the climbing wall. The anchoring aperture can be formed in the anchoring mass at an angle to the planar surface of the anchoring mass based on the angle of the climbing wall to which the climbing wall anchor is to be attached.

The method illustrated in FIG. 9, can further include selecting a second anchoring aperture attribute based on a second angle of the climbing wall to which the wall anchor receiver is to be attached. The method can further include forming a second anchoring aperture having the second anchoring aperture attribute selected. The first and second anchoring apertures can have a cylindrical cross-sectional shape each defined by a centerline. And, the centerline of the first anchoring aperture is formed at a different angle relative to the planar surface of the anchoring mass as opposed to the centerline of the second anchoring aperture.

Figure 10:
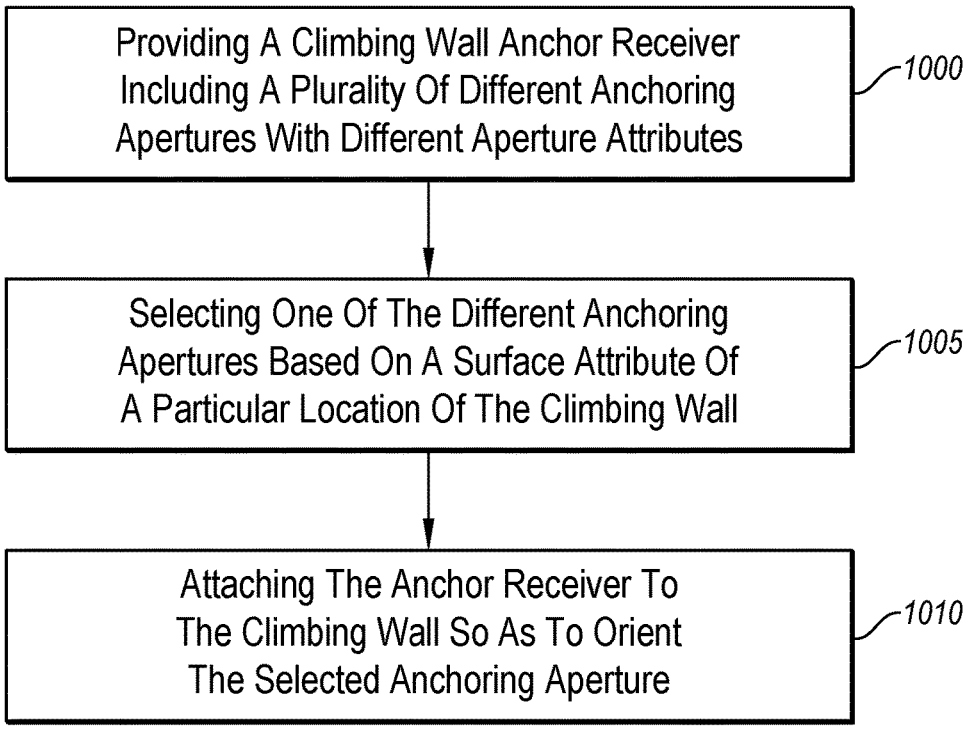
FIG. 10 illustrates a method of mounting a climbing wall anchor receiver to a climbing wall.

A method of mounting a climbing wall anchor receiver to a climbing wall is illustrated in FIG. 10, the method can include providing a climbing wall anchor receiver including a plurality of different anchoring apertures (1000). The different anchoring apertures can be designed for different climbing wall angles disposed about a periphery of the climbing wall anchor receiver. The method can include selecting one of the different anchoring apertures based on a planar surface angle of a particular location of the climbing wall (1005).

The method can include attaching the anchor receiver to the climbing wall so as to selectively orient the anchoring apertures (1010). The anchor receiver can be attached to the wall in a position for the one of the different anchoring apertures to be made the most accessible anchoring aperture to a corresponding anchor appendage of a climbing device. A plurality of climbing wall anchor receivers can be attached to a climbing wall having differently angled climbing surfaces thereon. The climbing wall anchor receivers can include a plurality of different anchoring apertures designed for the different climbing wall angles of the climbing wall. One of the different anchoring apertures of each climbing wall anchor receiver can be selected based on a planar surface angle of a particular location of the climbing wall to which the particular wall anchor receiver will be attached. Each anchor receiver can be rotationally positioned relative to the climbing wall for a particular one of the different anchoring apertures to be made the most accessible anchoring aperture to a corresponding anchor appendage of a climbing device depending on the angle of the climbing wall surface to which the anchor receiver is attached. And, each climbing wall anchor can be attended to the climbing wall according to the selected position.

One skilled in the art will appreciate that, for this and other processes and methods disclosed herein, the functions performed in the processes and methods may be implemented in differing order. Moreover, the structures of apparatus may be reorganized or variated used to accomplish a given feature or function. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 routes refers to groups having 1, 2, or 3 routes. Similarly, a group having 1-5 impact zones refers to groups having 1, 2, 3, 4, or 5 impact zones and more or less, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A climbing system, comprising:
a climbing apparatus including:
a handle; and
an anchoring appendage being substantially rigid, cylindrical, and extending at an acute angle less than 80 degrees to an axis of the handle, the cylindrical anchoring appendage rigidly coupled to the handle; and
an anchor receiver, including:
means for attaching the anchor receiver to an obstacle structure; and
an aperture in the anchor receiver, the aperture corresponding in shape to the anchoring appendage of the climbing apparatus to temporarily secure the climbing apparatus to the anchor receiver.

2. The climbing system according to claim 1, the anchor receiver including a planar surface for abutting a climbing surface of the obstacle structure and a plurality of apertures in the anchor receiver, the plurality of apertures disposed at different angles to the planar surface of the anchor receiver.

3. The climbing system according to claim 2, wherein each of the plurality of apertures are defined by a substantially cylindrical sidewall having a centerline.

4. The climbing system according to claim 3, wherein the centerline of each aperture is disposed at a different angle to the planar surface of the anchor receiver to accommodate a different angle of the climbing surface to which the anchoring device is to be attached.

5. The climbing system according to claim 3, wherein the anchor receiver is rotatable about a centerline of the anchor receiver so as to select an upper-most aperture having an aperture centerline angle to the centerline of the anchor receiver depending on a different climbing surface angle to which the anchoring device is attached.

6. The climbing system according to claim 1, wherein the handle is connected to the anchoring appendage by an elongate member.

7. The climbing system according to claim 6, wherein an angle between the elongate member and the anchoring appendage is between 45 and 85 degrees.

8. The climbing system according to claim 6, wherein:
the elongate member is curved;
the anchoring appendage extends at an angle from a first end of the curved elongate member; and
the handle extends from a second end of the curved elongate member.

9. The climbing system according to claim 1, wherein the anchoring appendage includes a substantially cylindrical peg.

10. The climbing system according to claim 9, wherein an end of the cylindrical peg is substantially flat or blunt across a width of the cylindrical peg.

11. The climbing system according to claim 1, wherein an angle between the centerline of the handle and the direction of extension of the anchoring appendage is between 20 and 50 degrees.

12. The climbing system according to claim 1, wherein the angle between the handle and the anchoring appendage is between 30 and 40 degrees.

13. The climbing system according to claim 1, wherein the aperture includes a substantially cylindrical void in the anchor receiver.

14. The climbing system according to claim 1, comprising a set of anchor receivers, an anchoring appendage of each wall anchor receiver including a substantially cylindrical aperture defined by a different centerline disposed at a different non-perpendicular angle to a planar mounting surface of each anchor receiver.

15. The climbing system according to claim 1, wherein the cylindrical anchoring appendage is a wooden cylindrical peg with a flat tip extending across a width of the cylindrical anchoring appendage.

16. The climbing system according to claim 1, wherein the handle is connected to the cylindrical anchoring appendage by a substantially rigid elongate member.

17. The climbing system according to claim 1, wherein the handle and cylindrical anchoring appendage encapsulate an internal metallic strut.

18. A training system for ice axe climbing activity, comprising:
a climbing apparatus including:
a handle defined by a handle axis; and
an anchoring appendage defined by an anchoring appendage axis and extending at an acute angle less than 85 degrees to the handle axis, the anchoring appendage axis and the handle axis being defined by a common plane; and
an anchor receiver, including:
means for attaching the anchor receiver to an obstacle structure; and
an aperture in the anchor receiver, the aperture corresponding in shape to the anchoring appendage of the climbing apparatus to temporarily secure the climbing apparatus to the anchor receiver.

19. A training system according to claim 18, wherein the aperture includes a substantially cylindrical void in the anchor receiver and the aperture is defined by a centerline, wherein the centerline of the cylindrical aperture is defined by an angle greater than 15 degrees to a mounting plane of the anchor receiver.

20. A climbing system, comprising:
a climbing apparatus including:
a handle; and
an anchoring appendage extending at an acute angle less than 85 degrees to the handle; and
an anchor receiver, including:
means for attaching the anchor receiver to an obstacle structure; and
an aperture in the anchor receiver, the aperture corresponding in shape to the anchoring appendage of the climbing apparatus to temporarily secure the climbing apparatus to the anchor receiver, wherein the aperture includes a substantially cylindrical void in the anchor receiver and the substantially cylindrical aperture is defined by a centerline, wherein the centerline of the cylindrical aperture is defined by an angle greater than 15 degrees to a mounting plane of the anchor receiver.

* * * * *